US011346557B2

(12) United States Patent
Snyder

(10) Patent No.: US 11,346,557 B2
(45) Date of Patent: May 31, 2022

(54) AERODYNAMIC GUIDE PLATE COLLAR FOR SWIRLER ASSEMBLY

(71) Applicant: UNITED TECHNOLOGIES CORPORATION, Farmington, CT (US)

(72) Inventor: Timothy S. Snyder, Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 42 days.

(21) Appl. No.: 16/538,544

(22) Filed: Aug. 12, 2019

(65) Prior Publication Data

US 2021/0048196 A1 Feb. 18, 2021

(51) Int. Cl.
*F23R 3/14* (2006.01)
*F23R 3/28* (2006.01)

(52) U.S. Cl.
CPC ..... *F23R 3/283* (2013.01); *F23R 3/14* (2013.01); *F23R 3/286* (2013.01)

(58) Field of Classification Search
CPC ..... F23R 3/14; F23R 3/283; F23R 3/286
See application file for complete search history.

(56) References Cited

U.S. PATENT DOCUMENTS 3,853,273 A * 12/1974 Bahr ..... F23R 3/14 239/402
4,584,834 A * 4/1986 Koshoffer ..... F23R 3/04 60/737
5,417,070 A 5/1995 Richardson
5,941,075 A * 8/1999 Ansart ..... F23R 3/14 60/748
6,161,387 A * 12/2000 Green ..... F23R 3/14 60/742
8,689,563 B2 4/2014 Low
10,253,976 B2 4/2019 Gunderson
2005/0044854 A1* 3/2005 Cazalens ..... F23R 3/286 60/740
2006/0042268 A1 3/2006 Markarian et al.
2006/0059915 A1* 3/2006 Furletov ..... F23D 11/24 60/740
2006/0207258 A1* 9/2006 Tanner ..... F16L 27/08 60/748
2008/0245075 A1* 10/2008 Snyder ..... F23R 3/14 60/748
2017/0059163 A1 3/2017 Ott et al.
2017/0122565 A1 5/2017 Mulcaire
2019/0003711 A1 1/2019 Reynolds et al.

OTHER PUBLICATIONS

European Patent Office, European Search Report dated Nov. 26, 2020 in Application No. 20188223.0.

* cited by examiner

*Primary Examiner* — Thomas P Burke
(74) *Attorney, Agent, or Firm* — Snell & Wilmer L.L.P.

(57) ABSTRACT

A guide plate for a swirler assembly is disclosed. In various embodiments, the guide plate includes a guide plate flange configured for engagement with a swirler body having a swirler inlet; and a guide plate collar, the guide plate collar having an aft protrusion with respect to an axial direction extending through the swirler body, the aft protrusion having an aft protrusion tip position configured to be equal to or extend downstream of a swirler inlet forward position with respect to the axial direction and a radially outer surface that forms a radially outer surface angle greater than ninety degrees with respect to a radial direction.

16 Claims, 5 Drawing Sheets

AERODYNAMIC GUIDE PLATE COLLAR FOR SWIRLER ASSEMBLY

FIELD

The present disclosure relates generally to gas turbine engines and, more particularly, to fuel swirlers used in combustor sections of gas turbine engines.

BACKGROUND

Gas turbine engines typically include a fan section, a compressor section, a combustor section and a turbine section. The fan section drives air along a bypass flow path while the compressor section drives air along a core flow path. In general, during operation, air is pressurized in the compressor section and is mixed with fuel and burned in the combustor section to generate hot combustion gases. Efficient and thorough mixing and combustion of the fuel and air is often facilitated using swirlers disposed upstream of a combustion zone where burning of the fuel and air occurs. Subsequent to combustion, the hot combustion gases flow through the turbine section, which extracts energy from the hot combustion gases to power the compressor section and other gas turbine engine loads, such as those required to rotate fan blades in the fan section. The compressor section typically includes low pressure and high pressure compressors, and the turbine section includes low pressure and high pressure turbines.

SUMMARY

A guide plate for a swirler assembly is disclosed. In various embodiments, the guide plate includes a guide plate flange configured for engagement with a swirler body having a swirler inlet; and a guide plate collar, the guide plate collar having an aft protrusion with respect to an axial direction extending through the swirler body, the aft protrusion having an aft protrusion tip position configured to be equal to or extend downstream of a swirler inlet forward position with respect to the axial direction and a radially outer surface that forms a radially outer surface angle greater than ninety degrees with respect to a radial direction.

In various embodiments, the radially outer surface angle is between ninety-five degrees and one-hundred forty-five degrees. In various embodiments, the radially outer surface angle is between one-hundred five degrees and one-hundred thirty-five degrees. In various embodiments, the aft protrusion defines a normalized length equal to an aft protrusion axial length divided by a swirler inlet axial length, the normalized length being between 0.5 and 2.0. In various embodiments, the aft protrusion defines a normalized tip position equal to the aft protrusion tip position minus a swirler inlet aft position divided by the swirler inlet axial length, the normalized tip position being between −1.0 and 1.0. In various embodiments, the aft protrusion axial length is equal to an axial distance between the aft protrusion tip position and an aft surface of the guide plate flange.

In various embodiments, the guide plate collar is disposed radially inward of the guide plate flange, the guide plate flange configured for sliding disposition against the swirler body. In various embodiments, a forward protrusion is disposed forward of the aft protrusion, the forward protrusion and the aft protrusion defining an opening through the guide plate configured to receive a fuel nozzle.

A swirler assembly is disclosed. In various embodiments, the swirler assembly includes a swirler body defining an axial direction and having a swirler inlet extending through the swirler body to a radially inner swirler surface of the swirler body; and a guide plate having a guide plate flange configured for engagement with the swirler body and a guide plate collar, the guide plate collar having an aft protrusion with respect to the axial direction, the aft protrusion having an aft protrusion tip position configured to be equal to or extend downstream of a swirler inlet forward position with respect to the axial direction and a radially outer surface that forms a radially outer surface angle greater than ninety degrees with respect to a radial direction.

In various embodiments, the aft protrusion defines a normalized length equal to an aft protrusion axial length divided by a swirler inlet axial length, the normalized length being between 0.5 and 2.0. In various embodiments, the aft protrusion defines a normalized tip position equal to the aft protrusion tip position minus a swirler inlet aft position divided by the swirler inlet axial length, the normalized tip position being between −1.0 and 1.0. In various embodiments, the radially outer surface angle is between ninety-five degrees and one-hundred forty-five degrees. In various embodiments, the aft protrusion axial length is equal to an axial distance between the aft protrusion tip position and an aft surface of the guide plate flange.

In various embodiments, the guide plate collar is disposed radially inward of the guide plate flange, the guide plate flange configured for sliding disposition against a retainer body. In various embodiments, a forward protrusion is disposed forward of the aft protrusion, the forward protrusion and the aft protrusion defining an opening through the guide plate configured to receive a fuel nozzle. In various embodiments, the retainer body includes a rectangular shape in axisymmetric cross section. In various embodiments, the retainer body includes an angled wall in axisymmetric cross section, the angled wall being non-perpendicular to the axial direction.

A method of swirling a compressed flow in a combustor of a gas turbine engine is disclosed. In various embodiments, the method includes the steps of: introducing the compressed flow through a swirler inlet extending through a swirler body defining an axial direction; and impinging the compressed flow onto a radially outer surface of an aft protrusion of a guide plate collar, the aft protrusion having an aft protrusion tip position configured to be equal to or extend downstream of a swirler inlet forward position with respect to the axial direction and the radially outer surface forming a radially outer surface angle greater than ninety degrees with respect to a radial direction.

In various embodiments, the aft protrusion defines a normalized length equal to an aft protrusion axial length divided by a swirler inlet axial length, the normalized length being between 0.5 and 2.0, wherein the aft protrusion defines a normalized tip position equal to the aft protrusion tip position minus a swirler inlet aft position divided by the swirler inlet axial length, the normalized tip position being between −1.0 and 1.0, and wherein the radially outer surface angle is between ninety-five degrees and one-hundred forty-five degrees.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1A:
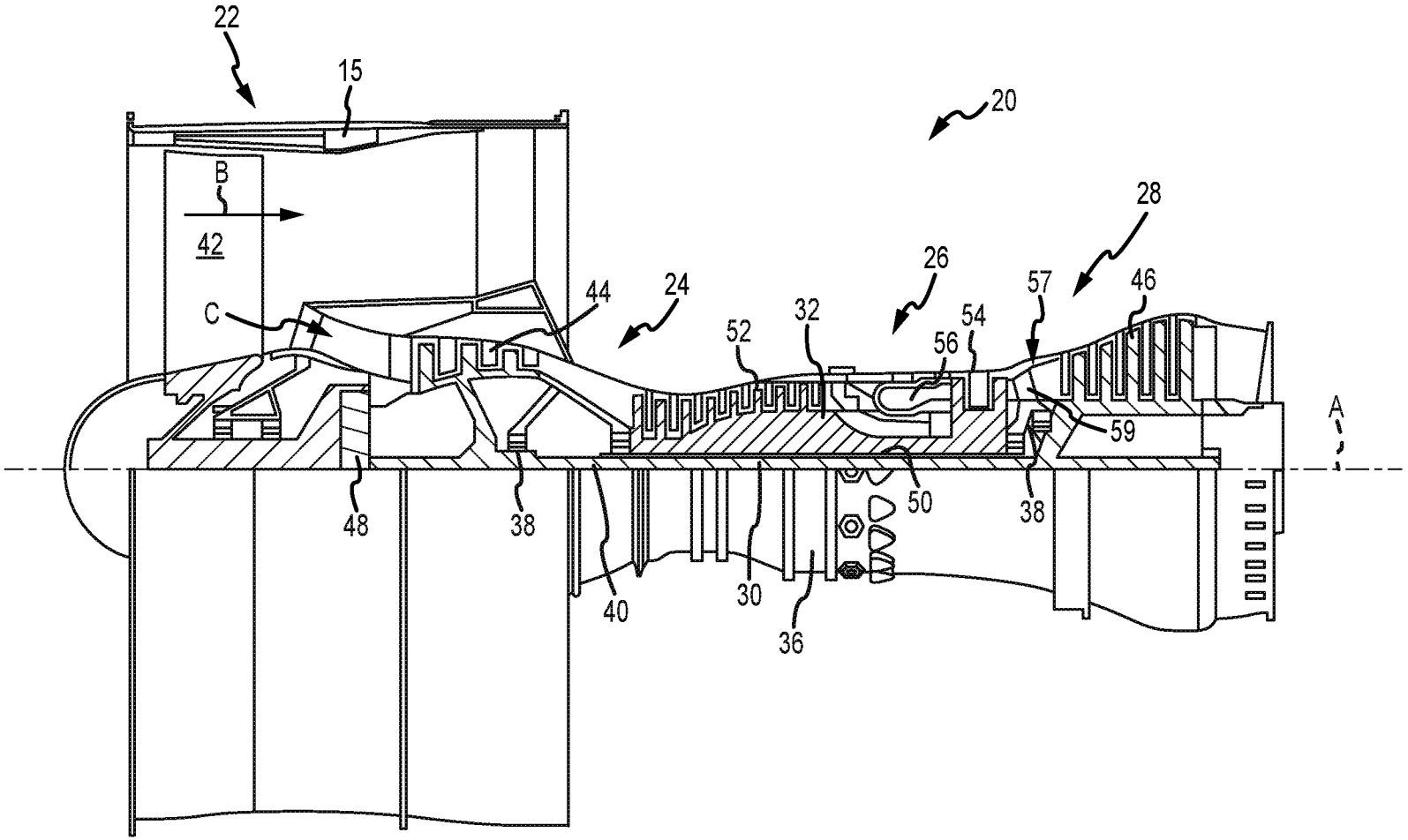
FIG. 1A is a cross sectional schematic view of a gas turbine engine, in accordance with various embodiments.

Referring now to the drawings, FIG. 1A schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, while the compressor section 24 drives air along a core flow path C for compression and communication into the combustor section 26 and then expansion through the turbine section 28. Although depicted as a two-spool turbofan gas turbine engine in the disclosed non-limiting embodiment, the concepts described herein are not limited to use with two-spool turbofans as the teachings may be applied to other types of turbine engines.

The gas turbine engine 20 generally includes a low speed spool 30 and a high speed spool 32 mounted for rotation about an engine central longitudinal axis A relative to an engine static structure 36 via several bearing systems 38. Various bearing systems at various locations may alternatively or additionally be provided and the location of the several bearing systems 38 may be varied as appropriate to the application. The low speed spool 30 generally includes an inner shaft 40 that interconnects a fan 42, a low pressure compressor 44 and a low pressure turbine 46. The inner shaft 40 is connected to the fan 42 through a speed change mechanism, which in this gas turbine engine 20 is illustrated as a fan drive gear system 48 configured to drive the fan 42 at a lower speed than that of the low speed spool 30. The high speed spool 32 includes an outer shaft 50 that interconnects a high pressure compressor 52 and a high pressure turbine 54. A combustor 56 is arranged in the gas turbine engine 20 between the high pressure compressor 52 and the high pressure turbine 54. A mid-turbine frame 57 of the engine static structure 36 is arranged generally between the high pressure turbine 54 and the low pressure turbine 46 and may include airfoils 59 in the core flow path C for guiding the flow into the low pressure turbine 46. The mid-turbine frame 57 further supports the several bearing systems 38 in the turbine section 28. The inner shaft 40 and the outer shaft 50 are concentric and rotate via the several bearing systems 38 about the engine central longitudinal axis A, which is collinear with longitudinal axes of the inner shaft 40 and the outer shaft 50.

The air in the core flow path C is compressed by the low pressure compressor 44 and then the high pressure compressor 52, mixed and burned with fuel in the combustor 56, and then expanded over the high pressure turbine 54 and the low pressure turbine 46. The low pressure turbine 46 and the high pressure turbine 54 rotationally drive the respective low speed spool 30 and the high speed spool 32 in response to the expansion. It will be appreciated that each of the positions of the fan section 22, the compressor section 24, the combustor section 26, the turbine section 28, and the fan drive gear system 48 may be varied. For example, the fan drive gear system 48 may be located aft of the combustor section 26 or even aft of the turbine section 28, and the fan section 22 may be positioned forward or aft of the location of the fan drive gear system 48.

Figure 1B:
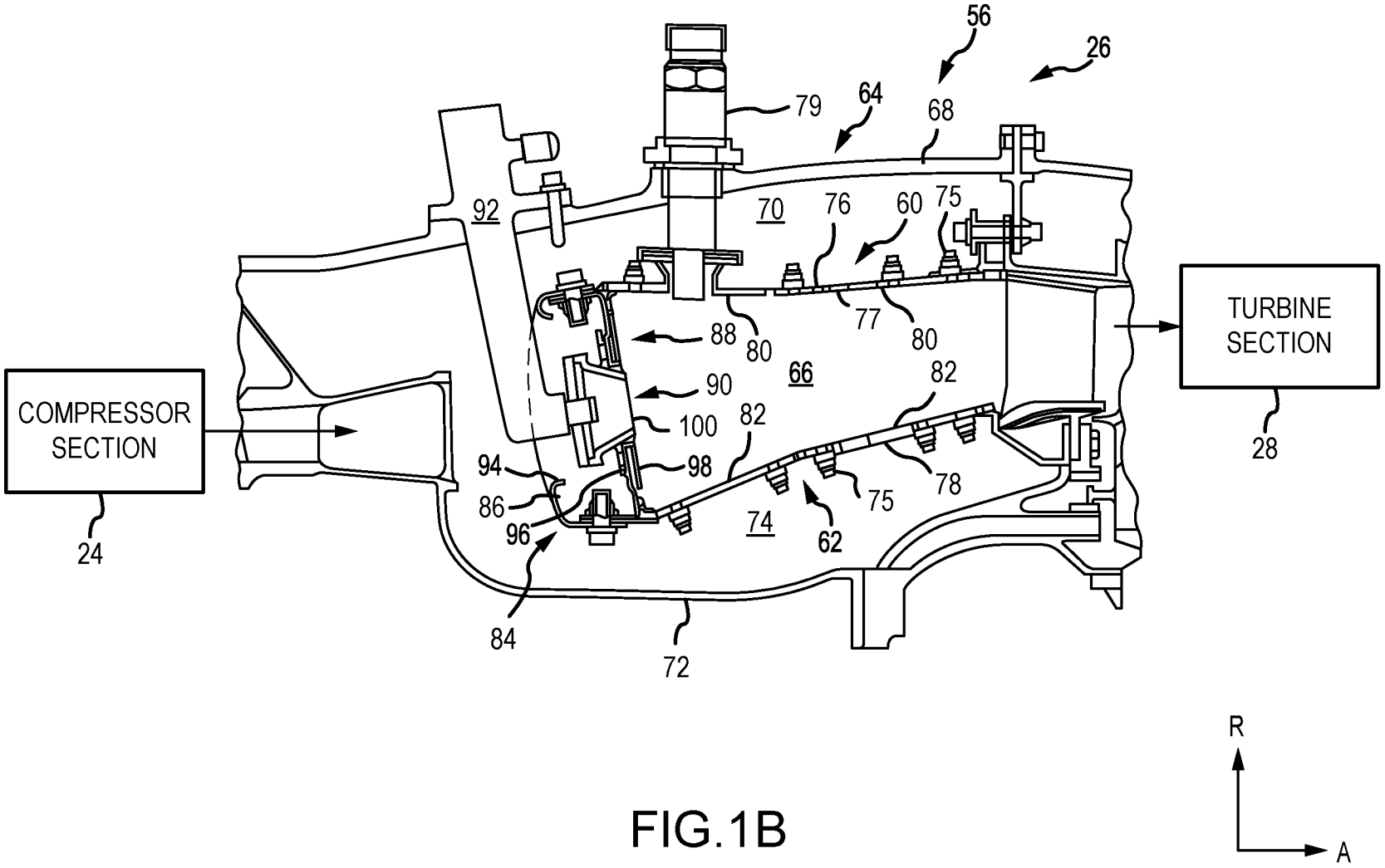
FIG. 1B is a cross sectional schematic view of a combustor section of a gas turbine engine, in accordance with various embodiments.

Referring to FIG. 1B, the combustor 56 may generally include an outer liner assembly 60, an inner liner assembly 62 and a diffuser case module 64 that surrounds the outer liner assembly 60 and the inner liner assembly 62. A combustion chamber 66, positioned within the combustor 56, has a generally annular configuration, defined by and comprising the outer liner assembly 60, the inner liner assembly 62 and a bulkhead liner assembly 88. The outer liner assembly 60 and the inner liner assembly 62 are generally cylindrical and radially spaced apart, with the bulkhead liner assembly 88 positioned generally at a forward end of the combustion chamber 66. The outer liner assembly 60 is spaced radially inward from an outer diffuser case 68 of the diffuser case module 64 to define an outer annular plenum 70. The inner liner assembly 62 is spaced radially outward from an inner diffuser case 72 of the diffuser case module 64 to define, in-part, an inner annular plenum 74. Although a particular combustor is illustrated, it should be understood that other combustor types with various combustor liner arrangements will also benefit from this disclosure. It should be further understood that the disclosed cooling flow paths are but an illustrated embodiment.

The combustion chamber 66 contains the combustion products that flow axially toward the turbine section 28. The outer liner assembly 60 includes an outer support shell 76 and the inner liner assembly 62 includes an inner support shell 78. The outer support shell 76 supports one or more outer panels 80 and the inner support shell 78 supports one or more inner panels 82. Each of the outer panels 80 and the inner panels 82 may be formed of a plurality of floating panels that are generally rectilinear and manufactured from, for example, a nickel based super alloy that may be coated with a ceramic or other temperature resistant material, and are arranged to form a panel configuration mounted to the respective outer support shell 76 and inner support shell 78. In various embodiments, the combination of the outer support shell 76 and the outer panels 80 is referred to an outer heat shield or outer heat shield liner, while the combination of the inner support shell 78 and the inner panels 82 is referred to as an inner heat shield or inner heat shield liner. In various embodiments, the panels are secured to the shells via one or more attachment mechanisms 75, which may each comprise a threaded stud and nut assembly.

The combustor 56 further includes a forward assembly 84 that receives compressed airflow from the compressor section 24 located immediately upstream. The forward assembly 84 generally includes an annular hood 86, a bulkhead liner assembly 88, and a plurality of swirler assemblies 90 (one shown). Each of the plurality of swirler assemblies 90 is aligned with a respective one of a plurality of fuel nozzles 92 (one shown) and a respective one of a plurality of hood ports 94 (one shown) to project through the bulkhead liner assembly 88; generally, the plurality of swirler assemblies 90, the plurality of fuel nozzles 92 and the plurality of hood ports 94 are circumferentially distributed about the annular hood 86 and the bulkhead liner assembly 88. The bulkhead liner assembly 88 includes a bulkhead support shell 96 secured to the outer liner assembly 60 and to the inner liner assembly 62 and a plurality of bulkhead panels 98 secured to the bulkhead support shell 96; generally, the plurality of bulkhead panels 98 is circumferentially distributed about the bulkhead liner assembly 88. The bulkhead support shell 96 is generally annular and the plurality of bulkhead panels 98 is segmented, typically one panel to each of the plurality of fuel nozzles 92 and the plurality of swirler assemblies 90. The annular hood 86 extends radially between, and is secured to, the forward-most ends of the outer liner assembly 60 and the inner liner assembly 62. Each of the plurality of hood ports 94 receives a respective one of the plurality of fuel nozzles 92 and facilitates the direction of compressed air into the forward end of the combustion chamber 66 through a respective one of a plurality of swirler openings 100. Each of the plurality of fuel nozzles 92 may be secured to the diffuser case module 64 and project through a respective one of the plurality of hood ports 94 and into a respective one of the plurality of swirler assemblies 90.

The forward assembly 84 introduces compressed air from the core flow path C into the forward section of the combustion chamber 66 while the remainder of the compressed air enters the outer annular plenum 70 and the inner annular plenum 74. The plurality of fuel nozzles 92 and adjacent structure generate a blended fuel-air mixture that supports stable combustion in the combustion chamber 66. An igniter 79 is located downstream of the plurality of fuel nozzles 92 used to ignite the blended fuel-air mixture. Air in the outer annular plenum 70 and the inner annular plenum 74 is also introduced into the combustion chamber 66 via a plurality of orifices 77, which may include dilution holes or air feed holes of various dimension. The outer support shell 76 may also include a plurality of impingement holes that introduce cooling air from the outer annular plenum 70 into a space between the outer support shell 76 and a cool side of the outer panels 80. The cooling air is then communicated through a plurality of effusion holes in the outer panels 80 to form a cooling air film across a hot side of the outer panels 80 to thermally protect the outer panels 80 from hot combustion gases. Similarly, the inner support shell 78 may include a plurality of impingement holes that introduce cooling air from the inner annular plenum 74 into a space between the inner support shell 78 and a cool side of the inner panels 82. The cooling air is then communicated through a plurality of effusion holes in the inner panels 82 to form a cooling air film across a hot side of the inner panels 82 to thermally protect the inner panels 82 from hot combustion gases.

Figure 2A:
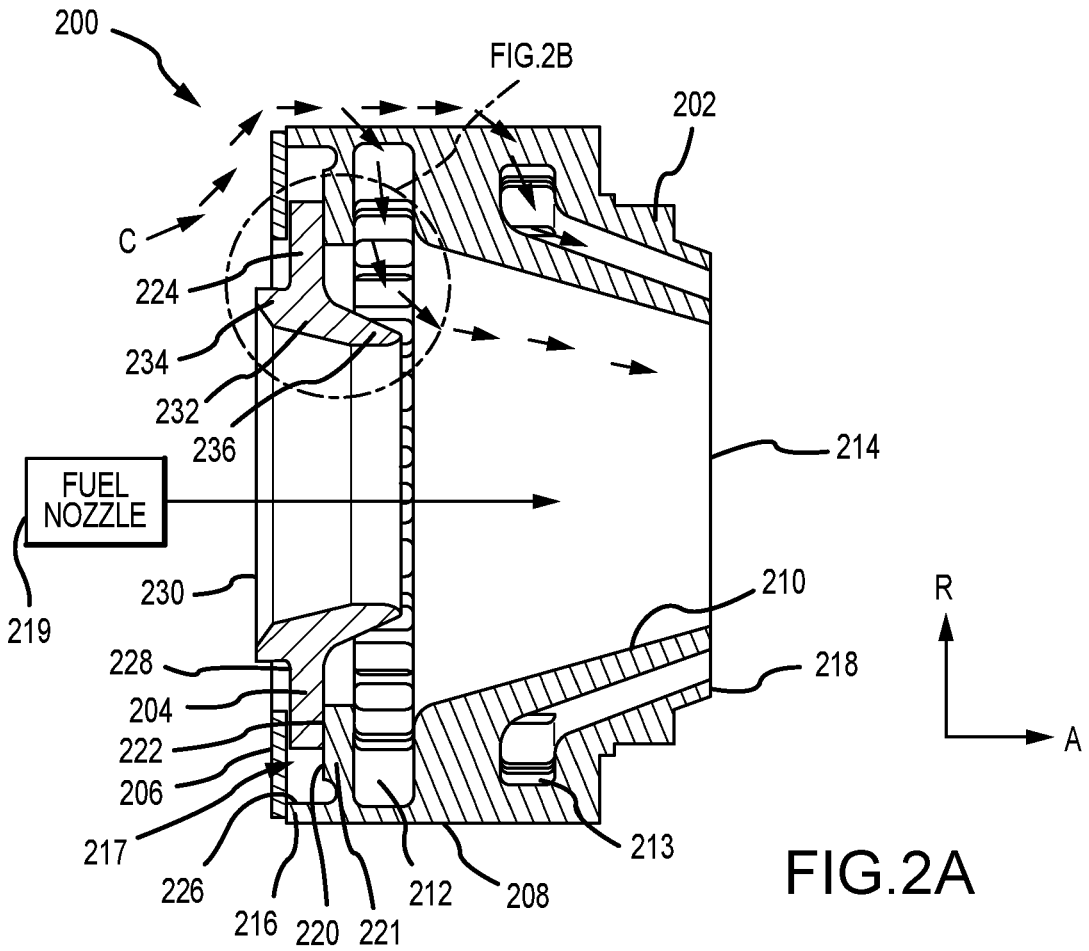
FIG. 2A is a cross sectional view of a swirler assembly, in accordance with various embodiments.
Figure 2B:
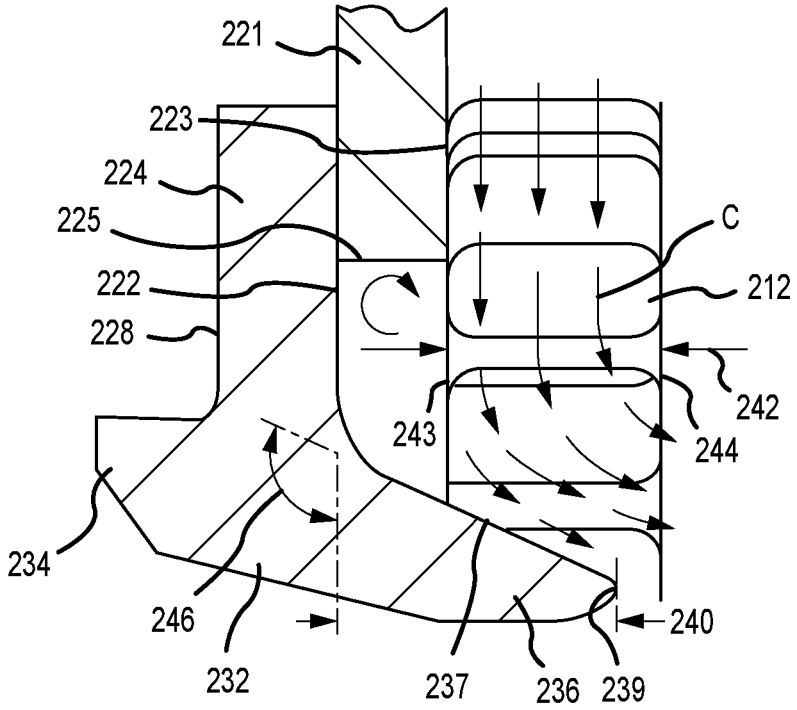
FIG. 2B is a close up cross sectional view of a guide plate collar and retainer body, in accordance with various embodiment.

Referring now to FIGS. 2A and 2B, a swirler assembly 200, such as, for example, one of the plurality of swirler assemblies 90 described above with reference to FIG. 1B, is illustrated with reference to an axial direction A and a radial direction R. The swirler assembly 200 may comprise a swirler body 202, a guide plate 204 and a retaining ring 206. In various embodiments, the swirler body 202 is configured to swirl airflow and provide the swirled airflow into a combustion chamber, such as, for example, the combustion chamber 66 described above with reference to FIG. 1B. The swirler body 202 may comprise a radially outer swirler surface 208 and a radially inner swirler surface 210. The swirler body 202 typically includes a plurality of primary swirler inlets 212 spaced circumferentially about the radially outer swirler surface 208. Each of the plurality of primary swirler inlets 212 defines a radial void extending through the radially outer swirler surface 208 that is configured to receive a flow of compressed air from a core flow path C (e.g., from the compressor section 24 described above with reference to FIGS. 1A and 1B), impart a swirl to the flow, and then introduce the swirling flow through the swirler body 202, via a swirler opening 214 extending along an axial length of the swirler body 202, and into the combustion chamber. The swirler body 202 may comprise a forward swirler body portion 216 located axially opposite an aft swirler body portion 218, between which the swirler opening 214 extends. In various embodiments, the swirler body may further comprise a plurality of secondary swirler inlets 213 disposed downstream of the plurality of primary swirler inlets 212 and configured to introduce a secondary swirling flow downstream of the aft swirler body portion 218.

In various embodiments, the forward swirler body portion 216 is configured to interface with the guide plate 204. For example, the swirler body 202 may comprise a forward swirler body face 220 that is positioned axially inward of the forward swirler body portion 216. The axially inward position provides for a swirler body recession 217 that extends circumferentially around the forward swirler body face 220 and is configured to at least partially receive an aft surface 222 of a guide plate flange 224. In this manner, the forward swirler body face 220 may comprise any suitable size capable of at least partially receiving the guide plate flange 224 within the swirler body recession 217. For example, the forward swirler body face 220 may comprise an inner diameter (in the radial direction) greater than an outer diameter of guide plate flange 224, such that the guide plate 204 may fit within the swirler body recession 217. The forward swirler body portion 216 may also define an annular wall portion 226 that circumferentially surrounds the forward swirler body face 220 and is sized to receive the guide plate flange 224. In various embodiments, the forward swirler body face 220 is considered part of a retainer body 221 that is configured to receive and retain, in conjunction with the retaining ring 206, the guide plate flange 224 within the swirler body recession 217.

In various embodiments, the guide plate 204 may be configured to at least partially provide sealing between the higher pressure upstream air located radially outward from the swirler body 202 and the lower pressure downstream air located within swirler body 202. In this regard, the guide plate 204 may provide sealing to ensure the compressed air from the compressor section is forced into the plurality of primary swirler inlets 212 extending in to the swirler body 202. In various embodiments, the guide plate 204 may comprise a forward surface 228 axially opposite the aft surface 222 of the guide plate flange 224. The aft surface 222 may be configured to couple to or interface with the forward swirler body face 220 of the retainer body 221, allowing the guide plate 204 to at least partially fit within swirler body 202 (or at least partially fit within the swirler body recession 217). The guide plate 204 may also comprise a guide plate opening 230 configured to receive a nozzle end of a fuel nozzle 219, such as, for example, one of the plurality of fuel nozzles 92 described above with reference to FIG. 1B. In various embodiments, the guide plate opening 230 defines an axial void that substantially aligns with the swirler opening 214 when the guide plate 204 is assembled with the swirler body 202 and the fuel nozzle 219.

In various embodiments, the guide plate 204 may comprise a guide plate collar 232 having a forward protrusion 234 and an aft protrusion 236. In various embodiments, the forward protrusion 234 is located on the forward surface 228 and extends in an axial direction away from the forward surface 228 of the guide plate 204. In various embodiments, the forward protrusion 234 may define a forward circumferential boundary for the guide plate opening 230. Similarly, the aft protrusion 236 is located on the aft surface 222 and extends in an axial direction away from the aft surface 222 of the guide plate 204. The aft protrusion 236 may define an aft circumferential boundary for the guide plate opening 230. In various embodiments, the forward circumferential boundary and the aft circumferential boundary are configured to receive the fuel nozzle 219 when assembled into the combustor. In various embodiments, the retaining ring 206 is configured to retain the guide plate flange 224 within the swirler body recession 217.

Referring more particularly to FIG. 2B, further details of the guide plate collar 232 of the guide plate 204 and the retainer body 221 are discussed. As illustrated, compressed air from the core flow path C is introduced into the interior of the swirler body 202 via the plurality of primary swirler inlets 212. In various embodiments, the aft protrusion 236 is configured such that the compressed air generally flows into the plurality of primary swirler inlets 212, along an aft surface 223 of the retainer body 221, over a radially outer surface 237 of the aft protrusion 236 and then downstream into the swirler opening 214 as a swirling flow. In various embodiments, the retainer body includes a rectangular shape (in axisymmetric cross section), with the aft surface being substantially perpendicular to the axial direction, that provides for a recirculation zone radially inward of a radially inner face 225 of the retainer body 221. In various embodiments, the recirculation zone, while unsteady, may be minimized in size to a region defined by an axial length of the radially inner face 225 of the retainer body 221.

Referring still to FIG. 2B, in various embodiments, the aft protrusion 236 is defined by an aft protrusion axial length 240, that extends an axial distance from the aft surface 222 of the guide plate 204 or the guide plate flange 224 to an aft protrusion tip position 239 of the aft protrusion 236. In various embodiments, the aft protrusion axial length 240 may be characterized with respect to a swirler inlet axial length 242 that extends from a swirler inlet forward position 243 to a swirler inlet aft position 244 of a swirler inlet or one of the plurality of primary swirler inlets 212. In various embodiments, for example, a normalized length or, more specifically, a normalized aft protrusion axial length ($L_{NORM}$) may be defined by dividing the aft protrusion axial length 240 by the swirler inlet axial length 242. In various embodiments, $L_{NORM}$ is within a range from $0.5 \leq L_{NORM} \leq 2.0$. Similarly, in various embodiments, a normalized tip position or, more specifically, a normalized aft protrusion tip position ($P_{NORM}$) may be defined by dividing the difference between the swirler inlet aft position 244 and the aft protrusion tip position 239 by the swirler inlet axial length 242. In various embodiments, $P_{NORM}$ is within a range from $-1.0 \leq P_{NORM} \leq 1.0$, where a value of zero indicates the swirler inlet aft position 244 and the aft protrusion tip position 239 are at the same axial location, a positive value indicates the swirler inlet aft position 244 is greater than the aft protrusion tip position 239 (as illustrated in FIG. 2A) and a negative value indicates the aft protrusion tip position 239 is greater than the swirler inlet aft position 244. In addition, in various embodiments, the aft protrusion 236 may be characterized by a radially outer surface angle 246, which represents an angle between the aft surface 222 of the guide plate 204 (or the radial direction R) and the radially outer surface 237 of the aft protrusion 236. In various embodiments, the radially outer surface angle 246 is between ninety-five degrees (95°) and one-hundred forty-five degrees (145°) and in various embodiments, the radially outer surface angle 246 is between one-hundred five degrees (105°) and one-hundred thirty-five degrees (135°).

Figure 3A:
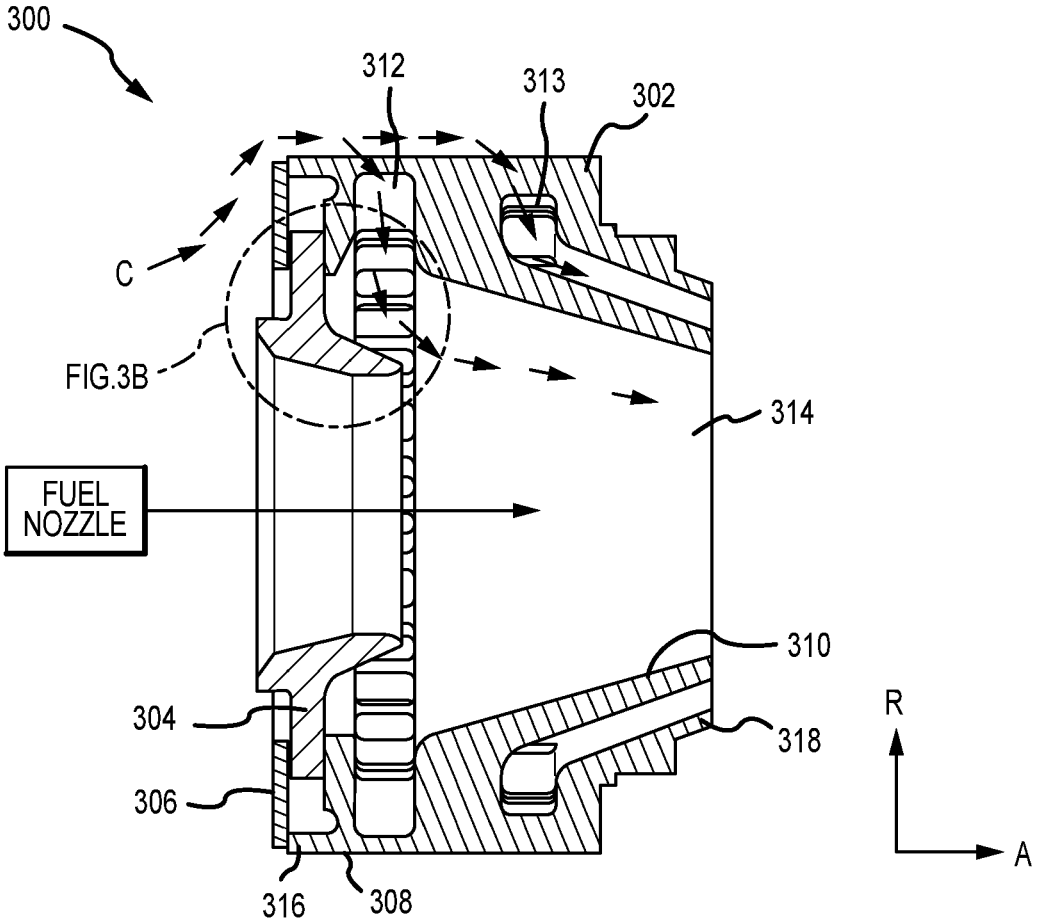
FIG. 3A is a cross sectional view of a swirler assembly, in accordance with various embodiments.
Figure 3B:
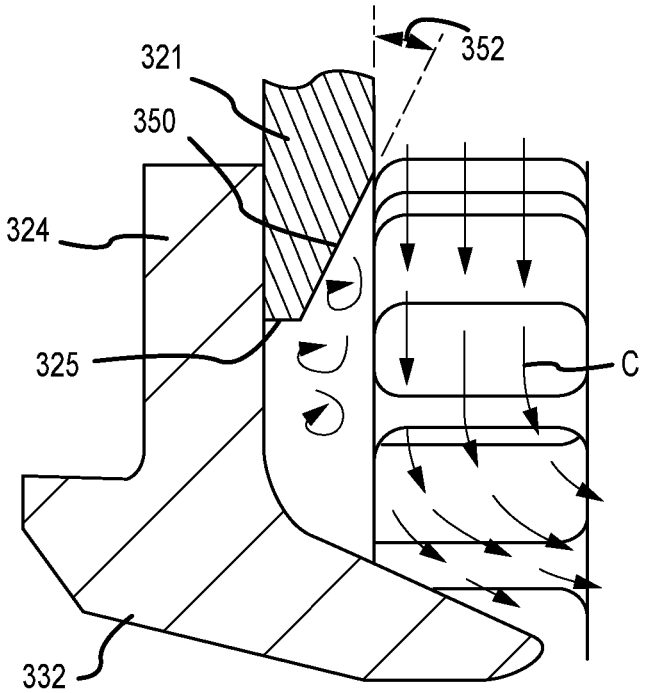
FIG. 3B is a close up cross sectional view of a guide plate collar and retainer body, in accordance with various embodiment.

Referring now to FIGS. 3A and 3B, a swirler assembly 300, such as, for example, one of the plurality of swirler assemblies 90 described above with reference to FIG. 1B, is illustrated. The swirler assembly 300 includes a swirler body 302, a guide plate 304 (including a guide plate flange 324 and a guide plate collar 332) and a retaining ring 306. In various embodiments, the swirler body 202 is configured to swirl airflow and provide the swirled airflow into a combustion chamber, such as, for example, the combustion chamber 66 described above with reference to FIG. 1B. The swirler body 302 may comprise a radially outer swirler surface 308 and a radially inner swirler surface 310. The swirler body 302 typically includes a plurality of primary swirler inlets 312 spaced circumferentially about the radially outer swirler surface 308. Each of the plurality of primary swirler inlets 312 defines a radial void extending through the radially outer swirler surface 308 that is configured to receive a flow of compressed air from a core flow path C (e.g., from the compressor section 24 described above with reference to FIGS. 1A and 1B), impart a swirl to the flow, and then introduce the swirling flow through the swirler body 302, via a swirler opening 314 extending along an axial length of the swirler body 302, and into the combustion chamber. The swirler body 302 may comprise a forward swirler body portion 316 located axially opposite an aft swirler body portion 318, between which the swirler opening 314 extends. In various embodiments, the swirler body may further comprise a plurality of secondary swirler inlets 313 disposed downstream of the plurality of primary swirler inlets 312 and configured to introduce a secondary swirling flow downstream of the aft swirler body portion 318.

With the exception of a retainer body 321, each of the constructional, dimensional and operational characteristics of the swirler assembly 200 described above with reference to FIGS. 2A and 2B are applicable to the swirler assembly 300, so are not repeated for the sake of brevity. As illustrated, the retainer body 321 includes an angled wall 350, rather than the aft surface 223 described above, which is substantially perpendicular to the axial direction. In various embodiments, the angled wall 350 provides a non-rectangular shape (in axisymmetric cross section) with the angled wall 350 being non-perpendicular to the axial direction. The angled wall 350 provides for a recirculation zone radially inward of the angled wall 350 that extends radially inward of a radially inner face 325 of the retainer body 321. In various embodiments, the recirculation zone, while unsteady, may be minimized in size to a region defined by an axial length of the radially inner face 325 of the retainer body 321, together with the length of the angled wall 350. In various embodiment, the angled wall 350 defines a retainer body angle 352 with respect to a plane perpendicular to the axial direction. In various embodiments, the retainer body angle 350 ranges from five degrees (5°) to eight-five degrees (85°).

In the various embodiments described above, a guide plate for a swirler assembly is disclosed. The guide plate facilitates different rates of thermal expansion between, for example, the inner diffuser case, the outer diffuser case and the components that comprise the combustor. In addition, the aft protrusion of the guide plate is configured to eliminate or substantially reduce in size regions of flow separation that may occur radially inward of a retainer body and a guide plate collar. In various embodiments, the regions of flow separation are eliminated or reduced in size by judicious design of an aft protrusion of the guide plate collar. Reducing is size the regions of unsteady flow described has the beneficial effect of reducing in strength a coupling that is believed to occur between fuel injection into the combustor and the shedding of vortices from the regions of unsteady flow. Reducing the strength of the coupling is further believed to have the effect of mitigating audible tones that result between the interaction of the unsteady flow (e.g., the shedding of vortices) and the fuel injection occurring downstream of the swirler body.

Figure 4:
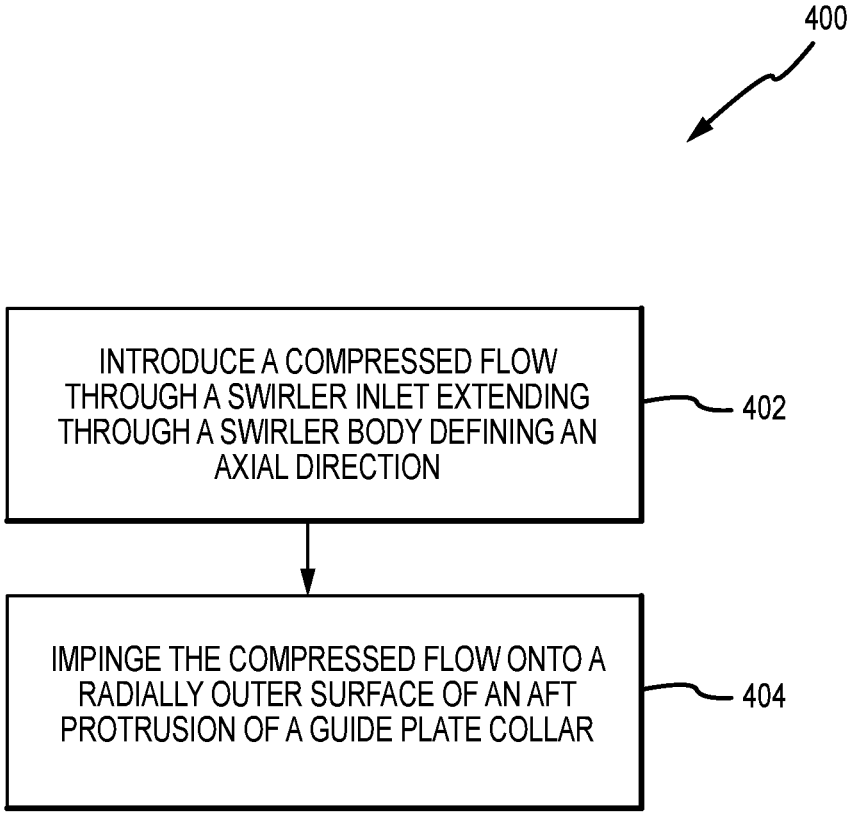
FIG. 4 is a flowchart illustrating a method of swirling a compressed flow in a combustor of a gas turbine engine, in accordance with various embodiments.

Referring now to FIG. 4, a method (400) of swirling a compressed flow in a combustor of a gas turbine engine is described. In various embodiments, a first step 402 includes introducing the compressed flow through a swirler inlet extending through a swirler body defining an axial direction. In various embodiments, a second step 404 includes impinging the compressed flow onto a radially outer surface of an aft protrusion of a guide plate collar, the aft protrusion having an aft protrusion tip position configured to be equal to or extend downstream of a swirler inlet forward position with respect to the axial direction and the radially outer surface forming a radially outer surface angle greater than ninety degrees with respect to a radial direction.

In various embodiments, the aft protrusion defines a normalized length equal to an aft protrusion axial length divided by a swirler inlet axial length, the normalized length being between 0.5 and 2.0, the aft protrusion defines a normalized tip position equal to the aft protrusion tip position minus a swirler inlet aft position divided by the swirler inlet axial length, the normalized tip position being between −1.0 and 1.0, and the radially outer surface angle is between ninety-five degrees and one-hundred forty-five degrees.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed is:

1. A swirler assembly, comprising:

a swirler body having a retainer body and a swirler inlet extending through the swirler body;

a guide plate flange configured for engagement with the swirler body; and a guide plate collar, the guide plate collar having an aft protrusion with respect to an axial direction extending through the swirler body, the aft protrusion having an aft protrusion tip position configured to be equal to or extend downstream of a swirler inlet forward position with respect to the axial direction and a radially outer surface that forms a radially outer surface angle greater than ninety degrees with respect to a radial direction, wherein the guide plate collar is disposed radially inward of the guide plate flange, the guide plate flange configured for sliding disposition against the retainer body, wherein the retainer body includes an angled wall in axisymmetric cross section, the angled wall defining a retainer body angle with respect to a plane perpendicular to the axial direction, the retainer body angle ranging from five degrees to eighty-five degrees, the angled wall providing for a recirculation zone radially inward of the angled wall and forward of the swirler inlet with respect to the axial direction, and wherein the angled wall provides a non-rectangular shape of the retainer body in axisymmetric cross section, with the angled wall being non-perpendicular to the axial direction and positioned forward of the swirler inlet and aft of the guide plate flange with respect to the axial direction.

2. The swirler assembly of claim 1, wherein the radially outer surface angle is between ninety-five degrees and one-hundred forty-five degrees.

3. The swirler assembly of claim 2, wherein the radially outer surface angle is between one-hundred five degrees and one-hundred thirty-five degrees.

4. The swirler assembly of claim 1, wherein the aft protrusion defines a normalized length equal to an aft protrusion axial length divided by a swirler inlet axial length, the normalized length being between 0.5 and 2.0.

5. The swirler assembly of claim 4, wherein the aft protrusion defines a normalized tip position equal to an axial difference between the aft protrusion tip position and a swirler inlet aft position divided by the swirler inlet axial length, the normalized tip position being between −1.0 and 1.0.

6. The swirler assembly of claim 5, wherein the radially outer surface angle is between ninety-five degrees and one-hundred forty-five degrees.

7. The swirler assembly of claim 4, wherein the aft protrusion axial length is equal to an axial distance between the aft protrusion tip position and an aft surface of the guide plate flange.

8. The swirler assembly of claim 7, wherein a forward protrusion is disposed forward of the aft protrusion, the forward protrusion and the aft protrusion defining an opening through the guide plate configured to receive a fuel nozzle.

9. A swirler assembly, comprising:

a swirler body defining an axial direction and having a swirler inlet extending through the swirler body to a radially inner swirler surface of the swirler body; and a guide plate having a guide plate flange configured for engagement with the swirler body and a guide plate collar, the guide plate collar having an aft protrusion with respect to the axial direction, the aft protrusion having an aft protrusion tip position configured to be equal to or extend downstream of a swirler inlet forward position with respect to the axial direction and a radially outer surface that forms a radially outer surface angle greater than ninety degrees with respect to a radial direction, wherein the guide plate collar is disposed radially inward of the guide plate flange, the guide plate flange configured for sliding disposition against a retainer body, wherein the retainer body includes an angled wall in axisymmetric cross section, the angled wall defining a retainer body angle with respect to a plane perpendicular to the axial direction, the retainer body angle ranging from five degrees to eighty-five degrees, the angled wall providing for a recirculation zone radially inward of the angled wall and forward of the swirler inlet with respect to the axial direction, and wherein the angled wall provides a non-rectangular shape of the retainer body in axisymmetric cross section, with the angled wall being non-perpendicular to the axial direction and positioned forward of the swirler inlet and aft of the guide plate flange with respect to the axial direction.

10. The swirler assembly of claim 9, wherein the aft protrusion defines a normalized length equal to an aft protrusion axial length divided by a swirler inlet axial length, the normalized length being between 0.5 and 2.0.

11. The swirler assembly of claim 10, wherein the aft protrusion defines a normalized tip position equal to an axial difference between the aft protrusion tip position and a swirler inlet aft position divided by the swirler inlet axial length, the normalized tip position being between −1.0 and 1.0.

12. The swirler assembly of claim 11, wherein the radially outer surface angle is between ninety-five degrees and one-hundred forty-five degrees.

13. The swirler assembly of claim 10, wherein the aft protrusion axial length is equal to an axial distance between the aft protrusion tip position and an aft surface of the guide plate flange.

14. The swirler assembly of claim 13, wherein a forward protrusion is disposed forward of the aft protrusion, the forward protrusion and the aft protrusion defining an opening through the guide plate configured to receive a fuel nozzle.

15. A method of swirling a compressed flow in a combustor of a gas turbine engine, comprising:

introducing the compressed flow through a swirler inlet extending through a swirler body defining an axial direction;

impinging the compressed flow onto a radially outer surface of an aft protrusion of a guide plate collar, the aft protrusion having an aft protrusion tip position configured to be equal to or extend downstream of a swirler inlet forward position with respect to the axial direction and the radially outer surface forming a radially outer surface angle greater than ninety degrees with respect to a radial direction, wherein the guide plate collar is disposed radially inward of a guide plate flange, the guide plate flange configured for sliding disposition against a retainer body, wherein the retainer body includes an angled wall in axisymmetric cross section, the angled wall defining a retainer body angle with respect to a plane perpendicular to the axial direction, the retainer body angle ranging from five degrees to eighty-five degrees, the angled wall providing for a recirculation zone radially inward of the angled wall and forward of the swirler inlet with respect to the axial direction, and wherein the angled wall provides a non-rectangular shape of the retainer body in axisymmetric cross section, with the angled wall being non-perpendicular to the axial direction and positioned forward of the swirler inlet and aft of the guide plate flange with respect to the axial direction.

16. The method of claim 15, wherein the aft protrusion defines a normalized length equal to an aft protrusion axial length divided by a swirler inlet axial length, the normalized length being between 0.5 and 2.0, wherein the aft protrusion defines a normalized tip position equal to an axial difference between the aft protrusion tip position and a swirler inlet aft position divided by the swirler inlet axial length, the normalized tip position being between −1.0 and 1.0, and wherein the radially outer surface angle is between ninety-five degrees and one-hundred forty-five degrees.

* * * * *